US006918453B2

(12) United States Patent
Haci et al.

(10) Patent No.: US 6,918,453 B2
(45) Date of Patent: Jul. 19, 2005

(54) METHOD OF AND APPARATUS FOR DIRECTIONAL DRILLING

(75) Inventors: Marc Haci, Houston, TX (US); Eric E. Maidla, Sugar Land, TX (US)

(73) Assignee: Noble Engineering and Development Ltd., Sugar Land, TX (US)

( * ) Notice: Subject to any disclaimer, the term of this patent is extended or adjusted under 35 U.S.C. 154(b) by 17 days.

(21) Appl. No.: 10/613,519

(22) Filed: Jul. 2, 2003

(65) Prior Publication Data

US 2004/0118612 A1 Jun. 24, 2004

Related U.S. Application Data

(63) Continuation-in-part of application No. 10/325,639, filed on Dec. 19, 2002.

(60) Provisional application No. 60/469,293, filed on May 10, 2003.

(51) Int. Cl.[7] ..... E21B 44/00

(52) U.S. Cl. ..... 175/26; 175/61

(58) Field of Search ..... 175/24, 26, 27, 175/40, 45, 61

(56) References Cited

U.S. PATENT DOCUMENTS 5,465,799 A 11/1995 Ho 6,050,348 A * 4/2000 Richarson et al. ..... 175/26

2002/0104685 A1 8/2002 Pinckard et al.

OTHER PUBLICATIONS

Canrig Drilling Technology, Ltd., sales brochure for Directional Steering Control Systems (DSCS).

Jean Michel Genevois, Jean Boulet, and Christophe Simon, Gyrostab Project: The Missing Link Azimuth and inclination mastered with new principles for standard rotary BHAs, Society of Petroleum Engineers, SPE/IADC 79915, Feb. 19, 2003.

* cited by examiner

*Primary Examiner*—William Neuder
(74) *Attorney, Agent, or Firm*—Townsend and Townsend and Crew LLP

(57) ABSTRACT

A method of and system for directional drilling reduces the friction between the drill string and the well bore. A downhole drilling motor is connected to a drilling rig at the surface by a drill string. The drilling motor is oriented at a selected tool face angle. The drill string is rotated at the surface in a first direction until a first torque magnitude is reached without changing the tool face angle. The drill string is then rotated in the opposite direction until a second torque magnitude is reached, again without changing the tool face angle. The drill string is rotated back and forth between the first and second torque magnitudes. Pressure inside the drill string is measured, and the first and second torque magnitudes are adjusted in response to changes in the pressure.

15 Claims, 2 Drawing Sheets

METHOD OF AND APPARATUS FOR DIRECTIONAL DRILLING

CROSS-REFERENCE TO RELATED APPLICATIONS

This is a continuation-in-part of application Ser. No. 10/325,639, Dec. 19, 2002, and titled METHOD OF AND APPARATUS FOR DIRECTIONAL DRILLING. The present application claims the benefit of Provisional Application Ser. No. 60/469,293, filed May 10, 2003, and titled METHOD OF AND APPARATUS FOR DIRECTIONAL DRILLING.

FIELD OF THE INVENTION

The present invention relates generally to the field of oil and gas well drilling. More particularly, the present invention relates to a method of and system for directional drilling in which the drill string is rotated back and forth between selected surface measured torque magnitudes without changing the tool face angle or changing the tool face angle to a desired value, thereby to reduce friction between the drill string and the well bore.

BACKGROUND OF THE INVENTION

It is very expensive to drill bore holes in the earth such as those made in connection with oil and gas wells. Oil and gas bearing formations are typically located thousands of feet below the surface of the earth. Accordingly, thousands of feet of rock must be drilled through in order to reach the producing formations. Additionally, many wells are drilled directionally, wherein the target formations may be spaced laterally thousands of feet from the well's surface location. Thus, in directional drilling, not only must the depth but also the lateral distance of rock must be penetrated.

The cost of drilling a well is primarily time dependent. Accordingly, the faster the desired penetration location, both in terms of depth and lateral location, is achieved, the lower the cost in completing the well.

While many operations are required to drill and complete a well, perhaps the most important is the actual drilling of the bore hole. In order to achieve the optimum time of completion of a well, it is necessary to drill at the optimum rate of penetration and to drill in the minimum practical distance to the target location. Rate of penetration depends on many factors, but a primary factor is weight on bit.

Directional drilling is typically performed using a bent housing mud motor drilling tool (known in the art as a "steerable motor") that is connected to the surface by a drill string. A steerable motor can control the trajectory of a bore hole by drilling in one of two modes. The first mode is called rotary drilling. In the rotary drilling mode, to maintain the trajectory of the bore hole at the existant azimuth and inclination, the drill string is rotated, such that the steerable motor rotates with the drill string.

The other mode is used to adjust the trajectory and is called "sliding drilling." During sliding drilling, the drill string is not rotated; rather, the drilling fluid circulated through the drill string causes the bit connected to the mud motor drilling tool to rotate. The direction of drilling (or the change in the trajectory) is determined by the tool face angle of the drilling bit. Tool face angle information is measured downhole by a steering tool or similar directional measuring instrument. Tool face angle information is typically conveyed from the steering tool to the surface using relatively low bandwidth drilling mud pressure modulation ("mud pulse") signaling. The driller (drilling rig operator) attempts to maintain the proper tool face angle by applying torque or drill string angle corrections to the drill string from the earth's surface using a rotary table or top drive on the drilling rig.

Several problems in directional drilling are caused by the fact that a substantial length of the drill string is in frictional contact with and supported by the bore hole. Since the drill string is not rotating in sliding drilling mode, it is difficult to overcome the friction. The difficulty in overcoming the friction makes it difficult for the driller to apply sufficient weight to the bit to achieve an optimal rate of penetration. The drill string also typically exhibits stick/slip friction such that when a sufficient amount of weight is applied to overcome the friction, the drill the weight on bit tends to overshoot the optimum magnitude, and in some cases the applied weight to the bit may be such that the torque capacity of the drilling motor is exceeded. Exceeding the torque capacity of the drilling motor may cause the motor to stall. Motor stalling is undesirable because the motor cannot drill when stalled. Moreover, stalling lessens the life of the drilling motor.

Additionally, the reactive torque that would be transmitted from the bit to the surface through drill string, if the hole were straight, is absorbed by the friction between the drill string and the borehole. Thus, during drilling, there is substantially no reactive torque at the surface. Moreover, when the driller applies drill string angle corrections at the surface in an attempt to correct the tool face angle, a substantial amount of the angular change is absorbed by friction without changing the tool face angle in stick/slip fashion. When enough angular correction is applied to overcome the friction, the tool face angle may overshoot its target, thereby requiring the driller to apply a reverse angular correction.

It is known in the art that the frictional engagement between the drill string and the borehole can be reduced by rotating the drill string back and forth ("rocking") between a first angle and a second angle measured at the earth's surface. By rocking the string, the stick/slip friction is reduced, thereby making it easier for the driller to control the weight on bit and make appropriate tool face angle corrections. A limitation to using surface angle alone as basis for rocking the drill string is that it does not account for the friction between the wall of the bore hole and the drill string. Rocking to a selected angle may either not reduce the friction sufficiently to be useful, or may exceed the friction torque of the drill string in the bore hole, thus unintentionally changing the tool face angle of the drilling motor. Further, rocking the tool face angle alone may result in motor stalling if too much weight is suddenly transferred to the bit as friction is overcome.

SUMMARY OF THE INVENTION

The present invention, in one aspect, provides a method for directional drilling that reduces the friction between the drill string and the bore hole. According to the present invention, a downhole drilling motor is connected to a drilling rig at the surface by a drill string. The drilling motor is oriented at a selected tool face angle. The drill string is rotated at the surface in a first direction until a first torque magnitude is reached without changing the tool face angle. The drill string is then rotated in the opposite direction until a second torque magnitude is reached, again without changing the tool face angle. The drill string is rocked back and forth between the first and second torque magnitudes. Pressure inside the drill string is measured, and the first and second torque magnitudes are adjusted in response to changes in the pressure.

Another aspect of the invention is a method of drilling a bore hole. According to this aspect, a method includes orienting a downhole drilling motor at a selected tool face angle, said drilling motor being connected by a drill string to a surface drilling location. The drill string is rotated at the surface location in a first direction until a first amount of rotation is reached. The drill string is then rotated in the direction opposite the first direction until a second amount of rotation is reached. Fluid pressure in the drill string is measured, and the first and second amounts of rotation are adjusted in response to changes in the fluid pressure.

DESCRIPTION OF THE PREFERRED EMBODIMENT

Figure 1:
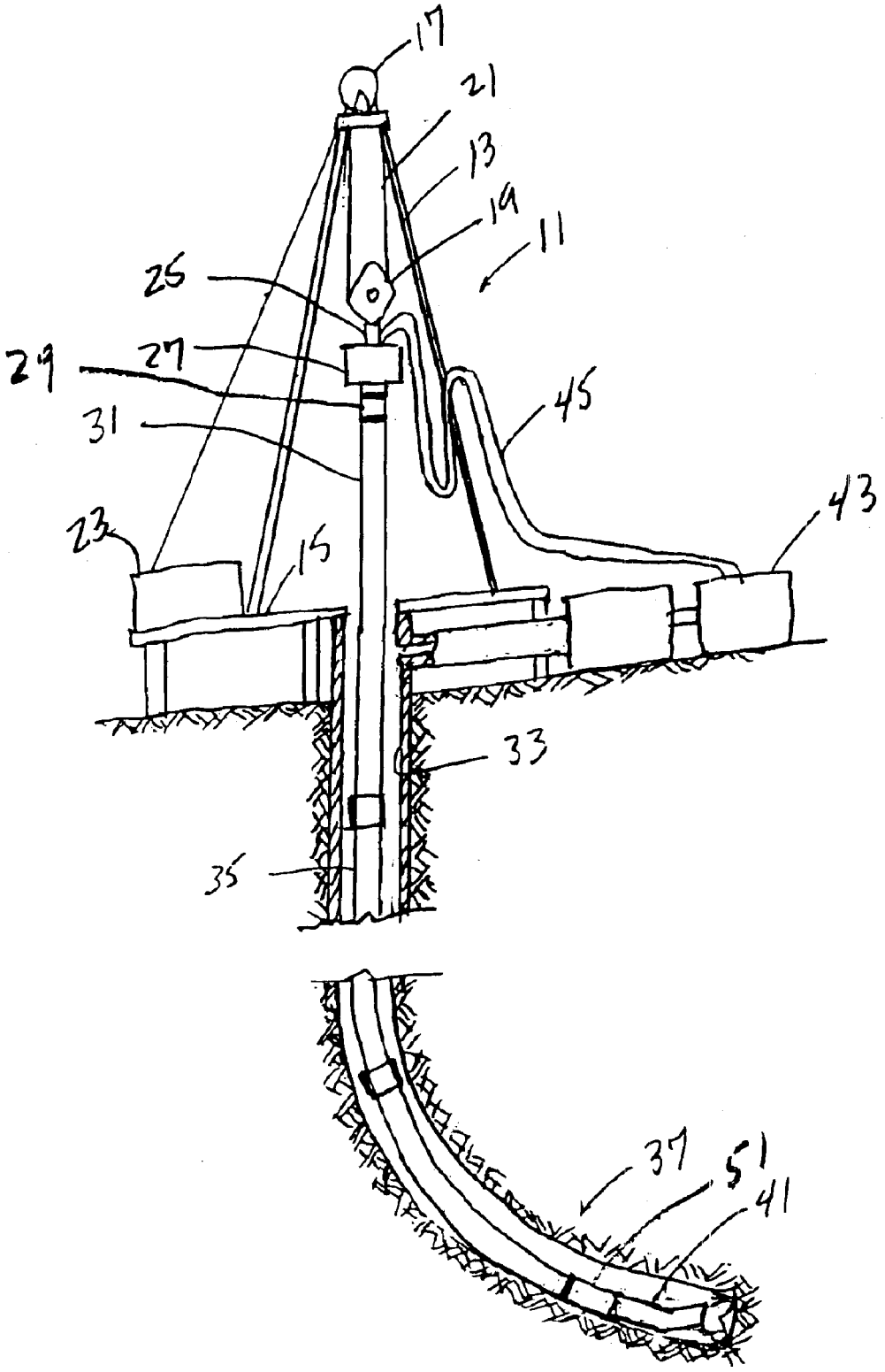
FIG. 1 is a pictorial view of a directional drilling system.

Referring to FIG. 1, a drilling rig is designated generally by reference numeral 11. The rig 11 in FIG. 1 is depicted as a "land" rig. However, as will be apparent to those skilled in the art, the method and system of the present invention will find equal application to non-land rigs, such as jack-up rigs, semisubmersible rigs, drill ships, and the like.

The rig 11 includes a derrick 13 that is supported on the ground above a rig floor 15. The rig 11 includes lifting gear, which includes a crown block 17 mounted to the derrick 13 and a traveling block 19. The crown block 17 and the traveling block 19 are interconnected by a cable 21 that is driven by a drawworks 23 to control the upward and downward movement of the traveling block 19. The traveling block 19 carries a hook 25 from which is suspended a top drive 27. The top drive 27 supports a drill string, designated generally by the numeral 35, in a well bore 33. The top drive 27 can be operated to rotate drill string 31 in either direction.

According to an embodiment of the present invention, the drill string 35 is coupled to the top drive 27 through an instrumented top sub 29. As will be discussed in detail hereinafter, the instrumented top sub 29 includes sensors that provide measurements of drill string torque according to the present invention.

The drill string 35 includes a plurality of interconnected sections of drill pipe (not shown separately), a bottom hole assembly (BHA) 37, which may include stabilizers, drill collars, and a suite of measurement while drilling (MWD) instruments including a steering tool or directional sensor 51. As will be explained in detail hereinafter, steering tool or directional sensor 51 provides tool face angle measurements that can be used according to the present invention.

A steerable drilling motor 41 is connected to the bottom of the BHA 37. As is well known to those skilled in the art, the tool face angle of the drilling motor 41 is used to correct or adjust the azimuth and/or inclination of the bore hole 33 during sliding drilling. Drilling fluid is delivered to the interior of the drill string 35 by mud pumps 43 through a mud hose 45. During rotary drilling, the drill string 35 is rotated within the bore hole 33 by the top drive 27. As is well known to those skilled in the art, the top drive 27 is slidingly mounted on parallel vertically extending rails (not shown) to resist rotation as torque is applied to the drill string 35. During sliding drilling, the drill string 35 is held rotationally in place by top drive 27 while the drill bit 40 is rotated by the drilling motor 41. The motor 41 is ultimately supplied with drilling fluid by the mud pumps 43.

The rig operator (driller) can operate the top drive 27 to change the tool face angle of the bit of drilling motor 41 by rotating the entire drill string 35. Although a top drive rig is illustrated in FIG. 1, those skilled in the art will recognize that the present invention may also be used in connection with systems in which a rotary table and kelly are used to apply torque to the drill string. The cuttings produced as the bit 40 drills into the earth are carried out of bore hole 33 by the drilling mud supplied by the mud pumps 43.

The discharge side of the mud pumps 43 includes a pressure sensor 63 (FIG. 2) operatively coupled thereto. The pressure sensor 63 makes measurements corresponding to the pressure inside the drill string 35. The actual location of the pressure sensor 63 is not intended to limit the scope of the invention. It is only necessary to provide a measurement corresponding to the drilling fluid pressure inside the drill string 35. Some embodiments of an instrumented sub 29, for example, may include a pressure sensor.

Figure 2:
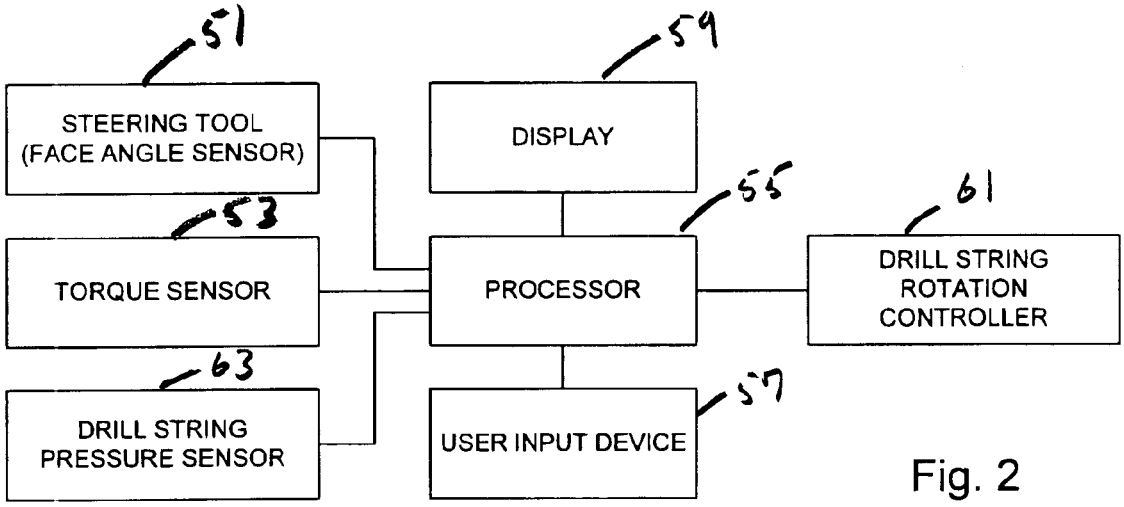
FIG. 2 is a block diagram of a directional driller control system according to the present invention.

Referring now to FIG. 2, there is shown a block diagram of one embodiment of the present invention. The system of the present invention includes a steering tool or directional sensor 51, which produces a signal indicative of drill tool face angle of the steerable motor (41 in FIG. 1). Typically, the steering tool 51 uses mud pulse telemetry to send signals to a surface receiver (not shown), which outputs a digital tool face angle signal. However, because of the limited bandwidth of mud pulse telemetry, the tool face angle signal is produced at a rate of once every several seconds, rather than at the preferred five times per second sampling rate. For example, the sampling rate for the tool face angle signal may be about once every twenty seconds. However, the sample rate for the tool face angle is not intended to limit the scope of the invention.

The system of the present invention also includes a drill string torque sensor 53, which provides a measure of the torque applied to the drill string at the surface. The drill string torque sensor 53 may be implemented as a strain gage in the instrumented top sub (29 illustrated in FIG. 1). The torque sensor 53 may also be implemented as a current measurement device for an electric rotary table or top drive motor, or as a pressure sensor for an hydraulically operated top drive. The drill string torque sensor 53 provides a signal which may be sampled electronically at the preferred sampling rate of five times per second. Irrespective of the implementation used, the torque sensor 53 provides a measurement corresponding to the torque applied to the drill string 35 at the surface by the top drive 27 (or rotary table where the rig is so equipped).

In FIG. 2, the outputs of directional sensor 51, the torque sensor 53 and the pressure sensor 63 are received at or otherwise operatively coupled to a processor 55. The processor 55 is programmed, according to the present invention, to process signals received from the sensors 51, 53 and 63. The processor 55 receives user input from user input devices 57, such as a keyboard, a touch screen, a mouse, a light pen, a keypad, and the like. The processor 55 may also provide visual output to a display 59. The processor 55 also provides output to a drill string rotation controller 61 that operates the top drive (27 in FIG. 1) or rotary table (not shown in the Figures) to rotate the drill string 35 according to the present invention.

According to the present invention, the drilling motor 41 is oriented at a tool face angle selected to achieve a desired trajectory for the bore hole 33 during sliding drilling. As the drilling motor 41 is advanced axially into the bore hole 33, the processor 55 operates the drill string rotation controller 61 to rotate drill string 35 in a first direction, while monitoring drill string torque with the torque sensor 53 and while monitoring tool face angle with the directional sensor 51. As long as the tool face angle remains substantially constant, the rotation controller 61 continues to rotate drill string 35 in the first direction. When the steering tool 51 senses a change in tool face angle, processor 55 notes the torque magnitude measured by the torque sensor 53 and actuates the drill string rotation controller 61 to reverse the direction of rotation of the drill string 31. Torque is a vector having a magnitude and a direction. When the torque sensor 53 senses that the magnitude of the drill string torque has reached the magnitude measured in the first direction, the processor 55 actuates rotation controller 61 reverse the direction of rotation of drill string (31 in FIG. 1). As drilling progresses, the processor 55 continues to monitor the torque applied to the drill string (35 in FIG. 1) with the torque sensor 53 and actuates rotation controller 61 to rotate drill string 35 back and forth between the first torque magnitude and the second torque magnitude. The back and forth rotation reduces or eliminates stick/slip friction between the drill string and the well bore, thereby making it easier for the driller to control weight on bit and tool face angle.

Alternatively, the torque magnitudes may be preselected by the system operator. When the torque detected by the sensor 53 reaches the preselected value, the processor 55 sends a signal to the controller 61 to reverse direction of rotation. The rotation in the reverse direction continues until the preselected torque value is reached again. In some embodiments, the preselected torque value is determined by calculating an expected rotational friction between the drill string (35 in FIG. 1) and the wellbore wall, such that the entire drill string above a selected point is rotated. The selected point is preferably a position along the drill string at which reactive torque from the motor 41 is stopped by friction between the drill string and the wellbore wall. The selected point may be calculated using "torque and drag" simulation computer programs well known in the art. Such programs calculate axial force and frictional/lateral force at each position along the drill string for any selected wellbore trajectory. One such program is sold under the trademark DDRAG™ by Maurer Technology, Inc., Houston, Tex.

In a method according to one aspect of the present invention, the processor 55 operates the drill string rotation controller 61 to rotate the drill string 35 between the first and second torque values. The processor 55 also accepts as input signals from the pressure sensor 63. The processor 55 can be programmed to adjust the first and second torque values in response to changes in the drilling fluid pressure as measured by the pressure sensor 63 such that a selected value of drilling fluid pressure is maintained.

As is known in the art, as the drawworks (23 in FIG. 1) is operated to release the drill string (35 in FIG. 1) into the bore hole (33 in FIG. 1), a portion of the weight of the drill string (35 in FIG. 1) is transferred to the drill bit (40 in FIG. 1). However, particularly during sliding drilling, much of the weight of the drill string (35 in FIG. 1) is not transferred to the bit (40 in FIG. 1) because of friction between the drill string (35 in FIG. 1) and the wall of the bore hole (33 in FIG. 1).

Rotating the drill string (35 in FIG. 1) between the first and second torque values reduces the amount of friction between the drill string and the wall of the bore hole. Reducing the friction enables more of the weight of the drill string (35 in FIG. 1) to be transferred to the drill bit (40 in FIG. 1) for any particular amount of "slack off" (reduction in the amount of drill string weight measured at the top drive). As is also known in the art, as the amount of weight transferred to the drill bit (40 in FIG. 1) increases, the pressure inside the drill string tends to increase, as the torque load on the drilling motor (41 in FIG. 1) correspondingly increases.

As is also known in the art, each type of drilling motor has a preferred operating fluid pressure. The preferred operating pressure is usually stated in terms of an increase over a "no load" condition, that is, the amount by which the pressure in the drill string increases over the pressure extant with the drill bit (40 in FIG. 1) suspended off the bottom of the bore hole (33 in FIG. 1).

In a method according to the present invention, the processor 55 is programmed to operate the drill string rotation controller 61 to rotate the drill string (35 in FIG. 1) to the first and second torque values. If the pressure in the drill string (35 in FIG. 1) falls below a selected set point or threshold, the first and second torque values may be increased automatically by the processor 55. If the drilling fluid pressure reaches the selected set point or threshold, the torque values may be maintained substantially constant. If the pressure in the drill string rises above the selected threshold or set point, the torque values may be reduced. By maintaining torque values such that a drill string pressure is maintained at a preferred or preselected value, a rate of penetration of the drill bit through the earth formations may be increased, while reducing the risk of "stalling" the drilling motor (exceeding the torque capacity of the motor causing bit rotation to stop. As is known in the art, stalling the drilling motor reduces its expected life and increases the risk of damage to the motor by distending elastomeric elements in the stator of the drilling motor (41 in FIG. 1). The preselected value of drill string pressure, or set point is preferably about equal to the preferred operating pressure of the drilling motor (41 in FIG. 1), less a safety factor, if desired.

In some embodiments, the amount of torque applied to the drill string may be momentarily increased above the selected value, for example, during one or two rotations in either the first or second directions, to make adjustments in the tool face angle. For example, if the driller desires to adjusts the tool face angle in a clockwise direction ("to the right" as referred to in the art) the amount of torque applied during clockwise rotation of the drill string may be increased above the selected value, to an amount which causes some rotation of the steerable motor in a clockwise direction. As will be readily appreciate by those skilled in the art, the amount of torque needed to move the tool face in a clockwise direction is an amount which exceeds the friction between the drill string and the bore hole as well as the reactive torque of the steerable motor.

Correspondingly, if the driller desires to make a counterclockwise adjustment ("to the left" as referred to in the art) to the tool face angle, the amount of torque applied to the drill string during counterclockwise rotation may be momentarily set above the predetermined or selected value so as to overcome the friction between the drill string and the bore hole. As will also be readily appreciated by those skilled in the art, adjustment "to the left" will require less torque than adjustment "to the right" because the reactive torque of the steerable motor during drilling applies a counterclockwise torque to the drill string above the drilling (steerable) motor. The processor 55 may be programmed to include an adjustment feature which provides an increase in rotation torque above the selected value in either the clockwise or counterclockwise directions for a selected number of rotations, e.g. one or two rotations, to provide an adjustment to the tool face angle. After the selected number of rotations, the torque applied is returned to the preselected value to maintain the tool face angle substantially constant.

In another aspect, the processor 55 may be programmed to operate the drill string rotation controller 61 to rotate the drill string a first selected amount (total angular displacement) in a first direction, and reverse rotation and rotate the drill string to a second selected amount (total angular displacement). In a method according to this aspect of the invention, the pressure measurements conducted to the processor 55 from the pressure sensor 63 are used to adjust the first and second amounts of rotation. In one embodiment, the amounts of rotation are decreased when the drill string pressure increases. The amounts of rotation are increased when the drill string pressure decreases. The amounts of rotation are adjusted in order to maintain the drill string pressure substantially constant. More preferably, the drill string pressure is maintained substantially at the preferred operating pressure of the drilling motor.

Controlling the total amount of rotation to maintain a substantially constant drill string pressure, and more preferably the preferred operating pressure of the drilling motor, may reduce the incidence of drilling motor stalling and may improve the life of the drilling motor (41 in FIG. 1).

In some embodiments, the amount of rotation applied to the drill string may be momentarily increased above the selected value, for example, during one or two rotations in either the first or second directions, to make adjustments in the tool face angle. For example, if the driller desires to adjusts the tool face angle in a clockwise direction ("to the right" as referred to in the art) the amount of rotation applied during clockwise rotation of the drill string may be increased above the selected value, to an amount which causes some rotation of the steerable motor in a clockwise direction. As will be readily appreciate by those skilled in the art, the amount of rotation needed to move the tool face in a clockwise direction is an amount which exceeds the friction between the drill string and the bore hole as well as the reactive torque of the steerable motor.

Correspondingly, if the driller desires to make a counterclockwise adjustment ("to the left" as referred to in the art) to the tool face angle, the amount of rotation applied to the drill string during counterclockwise rotation may be momentarily set above the predetermined or selected value so as to overcome the friction between the drill string and the bore hole. As will also be readily appreciated by those skilled in the art, adjustment "to the left" will require less rotation than adjustment "to the right" because the reactive torque of the steerable motor during drilling applies a counterclockwise torque to the drill string above the drilling (steerable) motor. The processor 55 may be programmed to include an adjustment feature which provides an increase in rotation amount above the selected value in either the clockwise or counterclockwise directions for a selected number of rotations, e.g. one or two rotations, to provide an adjustment to the tool face angle. After the selected number of rotations, the amount of rotation applied is returned to the preselected value to maintain the tool face angle substantially constant.

While the invention has been disclosed with respect to a limited number of embodiments, those of ordinary skill in the art, having the benefit of this disclosure, will readily appreciate that other embodiments may be devised which do not depart from the scope of the invention. Accordingly, the scope of the invention is intended to be limited only by the attached claims.

What is claimed is:

1. A method of drilling a bore hole, comprising:

(a) orienting a downhole drilling motor at a selected tool face angle, said drilling motor being connected by a drill string to a surface drilling location;

(b) rotating said drill string at said surface location in a first direction until a first torque magnitude is reached at said surface location;

(c) rotating said drill string the direction opposite said first direction until a second torque magnitude is reached at said surface location;

(d) measuring a fluid pressure in the drill string; and (e) adjusting the first and second torque magnitudes in response to changes in the fluid pressure.

2. The method as claimed in claim 1, wherein said second torque magnitude is substantially equal to said first torque magnitude.

3. The method as claimed in claim 1, wherein:

said drill string is rotated in said first direction to said first torque magnitude without changing said tool face angle; and, said drill string is rotated in said direction opposite said first direction to said second torque magnitude without changing said tool face angle.

4. The method as defined in claim 1 wherein said first torque magnitude is selected so that the drill string is rotated to a selected position axially therealong.

5. The method as defined in claim 4 wherein the selected position along the drill string is a position at which reactive torque from said drilling motor substantially stops communication along said still string.

6. The method of claim 1 wherein the first and second torque magnitudes are increased when the fluid pressure decreases and the torque magnitudes are decreased when the fluid pressure increases.

7. The method of claim 1 wherein the first and second torque magnitudes are adjusted to maintain the fluid pressure substantially at a value corresponding to a preferred operating pressure for the drilling motor.

8. The method of claim 1 further comprising momentarily increasing the torque above the first magnitude to cause a change in the tool face angle in the first direction.

9. The method of claim 1 further comprising momentarily increasing the torque above the second magnitude to cause a change in the tool face angle in the second direction.

10. A method of drilling a bore hole, comprising:

(a) orienting a downhole drilling motor at a selected tool face angle, said drilling motor being connected by a drill string to a surface drilling location;

(b) rotating said drill string at said surface location in a first direction until a first amount of rotation is reached at said surface location;

(c) rotating said drill string the direction opposite said first direction until a second amount of rotation is reached at said surface location;

(d) measuring a fluid pressure in the drill string; and (e) adjusting the first and second amounts of rotation in response to changes in the fluid pressure.

11. The method as claimed in claim 10, wherein said second amount of rotation is substantially equal to said first amount of rotation.

12. The method of claim 10, wherein the first and second amounts of rotation are increased when the fluid pressure decreases and the amounts of rotation are decreased when the fluid pressure increases.

13. The method of claim 10, wherein the first and second amounts of rotation are adjusted to maintain the fluid pressure at a value corresponding to a preferred operating pressure for the drilling motor.

14. The method of claim 10, further comprising momentarily increasing the amount of rotation above the first amount to cause a change in the tool face angle in the first direction.

15. The method of claim 10, further comprising momentarily increasing the amount of rotation above the second amount to cause a change in the tool face angle in the second direction.

* * * * *